US007793863B2

(12) United States Patent
Unruh

(10) Patent No.: US 7,793,863 B2
(45) Date of Patent: Sep. 14, 2010

(54) FUEL INJECTOR FOR AN INTERNAL COMBUSTION ENGINE

(75) Inventor: Marcus Unruh, Zeitlarn (DE)

(73) Assignee: Continental Automotive GmbH, Hannover (DE)

( * ) Notice: Subject to any disclaimer, the term of this patent is extended or adjusted under 35 U.S.C. 154(b) by 1196 days.

(21) Appl. No.: 10/963,465

(22) Filed: Oct. 11, 2004

(65) Prior Publication Data

US 2006/0038031 A1 Feb. 23, 2006

Related U.S. Application Data

(60) Provisional application No. 60/603,388, filed on Aug. 20, 2004.

(30) Foreign Application Priority Data

Aug. 20, 2004 (DE) ..... 10 2004 040 487
Sep. 1, 2004 (DE) ..... 10 2004 042 352

(51) Int. Cl.
*B05B 1/08* (2006.01)

(52) U.S. Cl. ..... 239/102.2; 310/344

(58) Field of Classification Search ..... 239/102.2; 310/363–366, 328, 344, 348; 335/220–229; 251/129.01, 129.15
See application file for complete search history.

(56) References Cited

U.S. PATENT DOCUMENTS 5,059,857 A 10/1991 Brandt et al. ..... 310/366
5,797,761 A 8/1998 Ring ..... 439/320
6,152,387 A * 11/2000 Ricco ..... 239/585.1
6,279,842 B1 8/2001 Spain ..... 239/585.1
6,341,984 B1 1/2002 Murakami et al. ..... 439/587
7,097,484 B2 8/2006 Schürz et al. ..... 439/279
7,275,958 B2 * 10/2007 Unruh ..... 439/587
7,394,184 B2 * 7/2008 Plecher et al. ..... 310/340

FOREIGN PATENT DOCUMENTS

DE 19844742 C1 3/2000
DE 198 44 743 C1 1/2001
DE 10045706 A1 4/2001
DE 199 56 256 A1 6/2001
DE 100 07 175 A1 8/2001

(Continued)

OTHER PUBLICATIONS

International Search Report for International Application No. PCT/DE03/00409 (3 pages), Jun. 4, 2003.

*Primary Examiner*—Christopher S Kim
(74) *Attorney, Agent, or Firm*—King & Spalding L.L.P.

(57) ABSTRACT

In the case of a fuel injector comprising an injector housing arrangement (44, 46) which accommodates a piezo-drive, whereby the piezo-drive has a piezo-actuator which is accommodated in a piezo-housing arrangement that has a cover arrangement (12, 14) provided with openings (16) for the penetration of protruding terminal pins (10) of the piezo-actuator, the following is provided:

a sealing arrangement comprising a sealing element (24) formed from a liquid-tight material, the sealing element, on the one hand, fitting tightly against the circumferential areas of the terminal pins (10) and, on the other hand, tightly against the cover arrangement (12, 14), and a ventilation arrangement (40, 42) that promotes an exchange of gas between the outside of the injector housing arrangement (44, 46) and the outside of the sealing element (24).

19 Claims, 3 Drawing Sheets

FOREIGN PATENT DOCUMENTS

| | | | |
|---|---|---|---|
| DE | 102 51 225 | A1 | 5/2004 |
| DE | 102004039673 | B3 | 4/2006 |
| EP | 1130249 | A2 | 9/2001 |
| JP | 2000197374 | A | 7/2000 |
| WO | 03/069152 | | 8/2003 |

* cited by examiner 40
30
46
28
32
31
42
22
24
34
18
19
26
10
44
14
36
38
A
12
20
16

64a
64a
62a
62a
28a
28a
40a
40a
40a
40a
30a
24a
60a
60a
10a
10a
22a
22a
16a
16a
14a
26a
38a
Piezo Actuator
12a
Fuel Injector
Actuator Housing 12a
Piezo Actuator

FUEL INJECTOR FOR AN INTERNAL COMBUSTION ENGINE

PRIORITY

This application claims priority to U.S. Provisional Application 60/603,388 filed Aug. 20, 2004; German application no. 10 2004 040 487.9 filed Aug. 20, 2004; and, German application no. 10 2004 042 352.0 filed Sep. 1, 2004.

TECHNICAL FIELD OF THE INVENTION

This invention relates to a fuel injector as well as the use of a fuel injector.

DESCRIPTION OF THE RELATED ART

Such a fuel injector is, for example, known from DE 102 51 225 A1. In the case of this prior art, a proposal is made to insert a fuel-resistant sealing ring (O-ring) into each opening of a mounted cover plate in order to create a durable, particularly oil-tight seal between a piezo-actuator and an external contact piece (contact module). In each through-opening, a sleeve made of an insulation material is also inserted below the seal ring, centering and electrically insulating the terminal pin.

A disadvantage when using this known arrangement for bringing into contact and sealing the piezo-actuator used, is that it requires a comparatively thick cover plate in order to accommodate a seal ring and a centering sleeve in the relevant through-openings in each case.

In addition, the piezo-drive of the known fuel injector also has a limited service life. It has been emphasized that this service life depends on the installation environment of the piezo-drive.

SUMMARY OF THE INVENTION

Accordingly, it is an object of this invention to improve a fuel injector of the above-mentioned type regarding the service life of its piezo-drive.

The fuel injector according to the invention is characterized by the following:

- a sealing arrangement comprising a sealing element formed from a liquid-tight material, said sealing element being mounted onto the terminal pin sections protruding from the openings and, on the one hand, fitting tightly against the circumferential areas of the terminal pin sections and, on the other hand, tightly against the cover arrangement, and
- a ventilation arrangement that promotes an exchange of gas between the outside of the injector housing arrangement and the outside of the sealing element and is formed by recesses of the injector housing arrangement.

In-house attempts by the applicant have surprisingly shown that the arrangement of a piezo-ceramic component such as the piezo-actuator which is of interest here in a piezo-housing arrangement sealed "as hermetically as possible" in an installation environment comprising hazardous agents, in practice does not lengthen the service life of the component, but rather has a tendency to even shorten the service life.

On the other hand, according to the invention the creation of a ventilation arrangement between the outside of the injector housing arrangement and the outside of the sealing element considerably lengthens the service life of the piezo-actuator. In addition, the sealing arrangement according to the invention is also particularly suitable for a comparatively thinly embodied cover arrangement because the sealing element seals outside this cover arrangement.

A possible explanation of the active mechanism of the invention is the fact that in the case of an actuator housing sealed as hermetically as possible, particularly as gas-tight as possible, under specific operating conditions, there is an underpressure in the inside of the housing (e.g. because of temperature fluctuations) through which hazardous agents can penetrate into the inside of the housing through the seal that need not be absolutely hermetical in practice. Other possible explanations, for example, may be that after having made a hermetically sealed piezo-drive, the concentration of any gas that shortens the service life increases in the interior of the piezo-drive or that a filling of the interior of the housing similar to atmospheric air has a positive effect on the service life of the piezo-electric ceramics.

It has at any rate been found that the promotion according to the invention of an exchange of gas between the outside of the injector housing arrangement and the outside of the sealing element has a tendency to lengthen the service life.

A preferred embodiment provides that the injector housing arrangement comprises a contact module mounted on the cover arrangement for the subsequent electrical connection of the terminal pins to a connector and this contact module is provided with gas exchange openings.

Such a contact module can, for example, be made from a plastic molded part with molded metal contacts to be welded with the terminal pins of the piezo-actuator. Such a contact module is, for example, described in DE 198 44 743 C1, in which case the support element of such a contact tongue carrier is intended for use in this invention with gas exchange openings (e.g. bores and/or molded part recesses).

In order to guarantee as good a liquid-tight seal as possible in the area of the system of the sealing element at the cover arrangement (axial sealing), one embodiment provides that the contact module presses the sealing element at least sectionwise against the cover arrangement. Therefore, these sealing element sections virtually clamped-in between the contact module and the cover arrangement can then, for example, bring about axial sealing.

The sealing element is preferably embodied as a disk consisting of one piece so that several (usually two) terminal pins of the piezo-actuator are sealed by one single sealing element. In this case, the sealing element can fit tightly in a sealing fashion annularly around the circumference of the cover arrangement in a simple way. All the terminal pins are then found radially within this circumference. However, an embodiment of the sealing element consisting of several parts is also basically feasible, for instance a separate sealing element part for each terminal pin, in which case each terminal pin in question is then fitted radially inside an axial seal which encircles the terminal pin. Even the latter "individual axial seal" running around each individual terminal pin can be brought about in a simple way by clamping an annularly closed sealing element area between the contact module and the cover arrangement.

The sealing element is pressed against the cover arrangement in a well-defined way if the contact module for this is provided with one or several projections facing the sealing element that on assembly of the fuel injector press the relevant sealing element sections.

A simple assembly of the contact module in the case of which the above-described pressing of the sealing element can be guaranteed is obtained when the contact module embraces a circumferential area of the cover arrangement and is held in this circumferential area by a form-locking connection. This form-locking connection can, in particular, be provided as a snap-in connection of such a type that only by pressing on the contact module will it lock with the cover arrangement. As a result, the snap-in connection can for example run annularly around the circumference or can even be provided through a number of separate snap-in areas distributed over the circumference.

In a preferred embodiment, the injector housing arrangement has an outer casing (e.g. plastic) in which there is at least one labyrinth-type gas exchange opening. With this design, particularly a penetration of solid materials into the area of the subsequent electrical connection can be avoided despite an existing gas exchange opening so that in particular a higher electrical reliability is given.

Although the option of making an outer casing provided with labyrinth-type gas exchange openings from one component or a plastic molding should not be excluded, a preferred embodiment provides that the injector housing arrangement consists of several components and at least one gas exchange opening which is provided as a gap between these components. Therefore, such gas exchange openings, particularly also labyrinth-type gaps, can then be manufactured very easily.

The gas exchange opening is preferably embodied in such a way that a liquid (e.g. fuel or oil) that has penetrated into the inside of the injector housing arrangement can again flow out. This is for example easily ensured by the fact that—under due consideration of a vertical application direction of the fuel injector—the gas exchange opening, from the inside to the outside, never extends "uphill", but particularly always downhill. Fuel injectors of the interesting type mentioned here usually have an injector housing arrangement extended in an axial direction, in which case the customary vertical application direction more or less conforms to this axial direction.

In a preferred embodiment, the sealing element material is an elastomer and even more preferred an electrically insulating elastomer. By selecting an electrically insulating sealing element material, no special precautions need to be taken against insufficient electrical insulation of the terminal pins in this case where the cover arrangement conducts electrically. In this way, the latter is usually the case because the piezo-housing arrangement overall and, therefore, also the cover arrangement are usually completely made from metallic materials. If in an electrically conducting cover arrangement the material of the sealing element does not electrically insulate sufficiently, provision can be made that at least in the areas where the sealing element lies on the cover arrangement, the cover arrangement is electrically insulated, for example, with an insulating layer or an insulating part. This insulating layer can, for example, be embodied as an insulating disk that extends up to the vicinity of the circumferential area of the cover arrangement and also has openings for the penetration of the terminal pins. In this way, such an insulating disk can advantageously be provided with sleeve extensions (e.g. molded in one piece) that extend into the openings of the cover arrangement in order to insulate the terminal pins there from the inside wall of these openings.

A preferred embodiment provides that the material of the sealing element has a high gas permeability. A silicon material, particularly a fluoride silicon material, can be selected (e.g. elastomers of the type "LSR" or "FVMQ"). Even in the case of a comparatively high thickness of the sealing element, the latter materials make possible a high permeation rate compared to gaseous materials such as air. This feature is advantageous for the durability or service life of the piezoelectric ceramics of the piezo-drive. The selection of a sealing element material with a comparatively high gas permeability, to a certain extent improves the positive effect of the above-mentioned ventilation of the injector housing arrangement.

In this way, the fuel injector according to the invention is particularly suitable for use in an installation environment containing "hazardous agents". Such an environment is obtained particularly if a fuel injector and at least one additional component of a fuel injection device is arranged, in essence, completely within an engine block unit of the internal combustion engine. This in particular refers to the case in which components of the injection device that are accommodated within the engine block unit can also be arranged outside it without limiting their function. The term "engine block unit" in this case designates all the engine components containing lubricating oil, thus strictly speaking the "engine block" and the attachment parts (such as a cylinder head cover, etc.) in which the lubricating oil of the internal combustion engine is pumped or smeared or led back. In the case of this design there is a greater danger that hazardous agents (engine oil, fuel-thinned engine oil, water or the vapors of these substances) penetrate the inside of the fuel injector.

BRIEF DESCRIPTION OF THE DRAWINGS

Embodiments of the invention are explained below on the basis of the accompanying drawings. They are as follows.

DETAILED DESCRIPTION OF THE PREFERRED EMBODIMENTS

Figure 1:
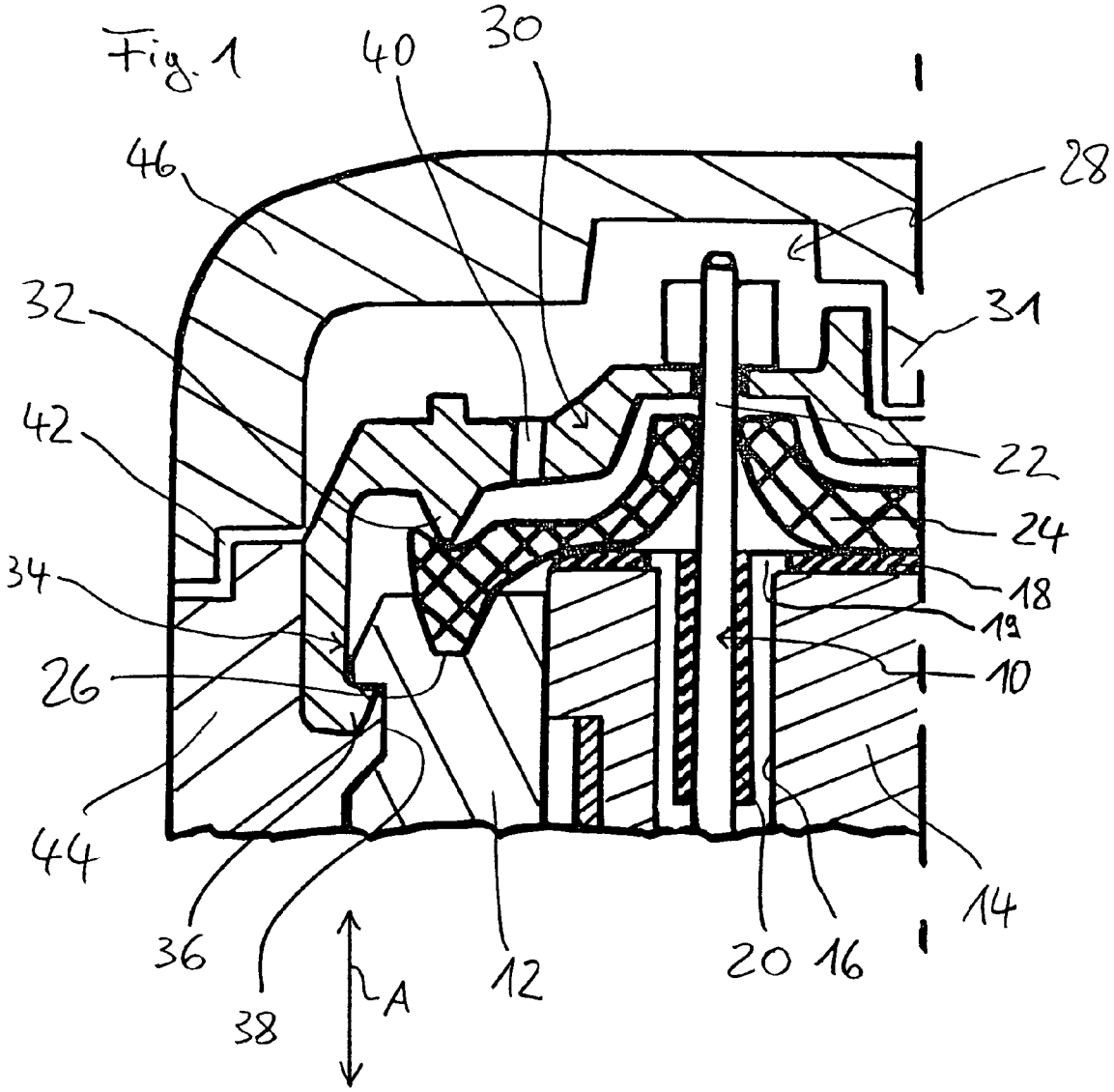
FIG. 1 is an axial longitudinal section of a fuel injector in the area of the seal of a terminal pin of the piezo-actuator used.

According to the invention, FIG. 1 shows the layout of an inventive fuel injector according to a first embodiment. The fuel injector comprises the well-known injector housing arrangement extended in an axial direction A in which a fuel injection valve and a piezo-drive interconnected via an operative connection to actuate the fuel injection valve are accommodated. With regard to the basic structure of the fuel injector, only for example the known fuel injectors are referred to in the same way as described in DE 199 56 256 B4 and DE 100 07 175 A1.

FIG. 1 shows a part of the extended fuel injector in the area of its upper axial end.

In this way, the piezo-drive has a piezo-actuator accommodated in an actuator housing, said piezo-actuator being embodied as a piezo-element stack extended in the axial direction A. FIG. 1 shows a total of two terminal pins 10 protruding in the axial direction A from the piezo-actuator, via which the piezo-drive is activated during operation.

A piezo-housing arrangement to be accommodated in the (not shown) piezo-actuator comprises, in the shown area, an actuator housing 12 surrounding the piezo-actuator like a sleeve as well as a cover plate 14 used and welded to this housing at the upper end. The shown upper end of the actuator housing 12 forms together with the cover plate 14 a cover arrangement, in which case the cover plate 14 is provided with openings in the form of bores 16 for the axial penetration of the terminal pins 10.

In this way, lying directly on the cover plate and extending up to its circumferential area, a perforated insulating disk 18 made of electrically high insulating material (e.g. polyamide)

is arranged, from which sleeve extensions 20 molded in one piece extend into the bores 16 of the cover plate 14 and the terminal pins 10 are centered there and insulated electrically from the inside wall of the bores 16. The perforation of the insulating disk 18 can for example be identified here at a passage opening 19.

The terminal pins 10 protrude upward with the terminal pin sections 22 from the bores 16. A sealing element 24 is mounted onto these terminal pin sections 22, said sealing element on the one hand fitting closely against the circumferential areas of the terminal pin sections 22 and, on the other hand, tightly in an annular groove 26 of the upper end of the actuator housing 12. In this case, the sealing element 24 is formed from a fluoride silicon material with a comparatively high gas permeability so that a good liquid sealing of the inside area of the piezo-housing arrangement is created through pressing on the terminal pin sections (radial seal) and at the actuator housing 12 (axial seal), compared with a contacting area 28 to subsequently electrically connect the terminal pins 10, whereby however a comparatively high permeation rate for gaseous agents is made possible.

In this case, the radial seal is ensured by an elastic pretensioning of the sealing element material which reliably presses this material radially against the circumferential area of the terminal pin section. On the other hand, a reliable axial seal is obtained in the shown embodiment by means of a contact module 30 embodied as a plastic molded part with molded electrical connections, said contact module pressing with an annular projection 32 protruding downward in the axial direction A in the circumferential area of the sealing element 24 against the top of this sealing element, and in this way pressing the sealing element section under load reliably into the annular groove 26 of the actuator housing 12.

In this case, the contact module 30 embraces a circumferential area of the actuator housing 12 provided with a conical start-up area and is held in this area by a snap-in connection 34 after pressing on the area. According to FIG. 1, in this mounted state, a projection 36 of the contact module 30 protruding radially inward extends into a circumferential groove 38 of the actuator housing 12 arranged under the conical start-up area.

In order to promote the exchange of gas between the outside of the injector housing arrangement and the outside of the sealing element 24, both a gas exchange opening 40 at the contact module 30 and an additional gas exchange opening 42 are provided in an outer plastic casing of the injector housing arrangement. This results in an exchange of gas between the inside of the piezo-housing arrangement and the installation environment of the fuel injector which is advantageous for the service life of the piezo-actuator.

Of the outer plastic casing, a final plastic molding 44 can initially be seen in FIG. 1, said plastic molding being molded in the circumferential area of the gas exchange opening 42 up to for instance an axial height of the sealing element 24 after the pressing of the contact module 30 on the circumferential area of the actuator housing 12. This outer casing was then completed by a plastic cover 46 that as shown in this embodiment was connected to the previously applied molding 44 by means of ultrasonic welding. This embodiment consisting of two parts of the upper area of the injector housing arrangement has the advantage that the gas exchange opening 42 can be embodied in a simple way as a labyrinth-type remaining gap between these two casing components as shown in FIG. 1.

The labyrinth-type development of the outer ventilation opening 42 prevents a penetration of solid materials into the inside of this casing. In addition, the course of this opening 42 seen in FIG. 1 makes possible that a liquid such as engine oil penetrating the inside of the casing can again flow out by itself determined by the force of gravity.

Figure 2:
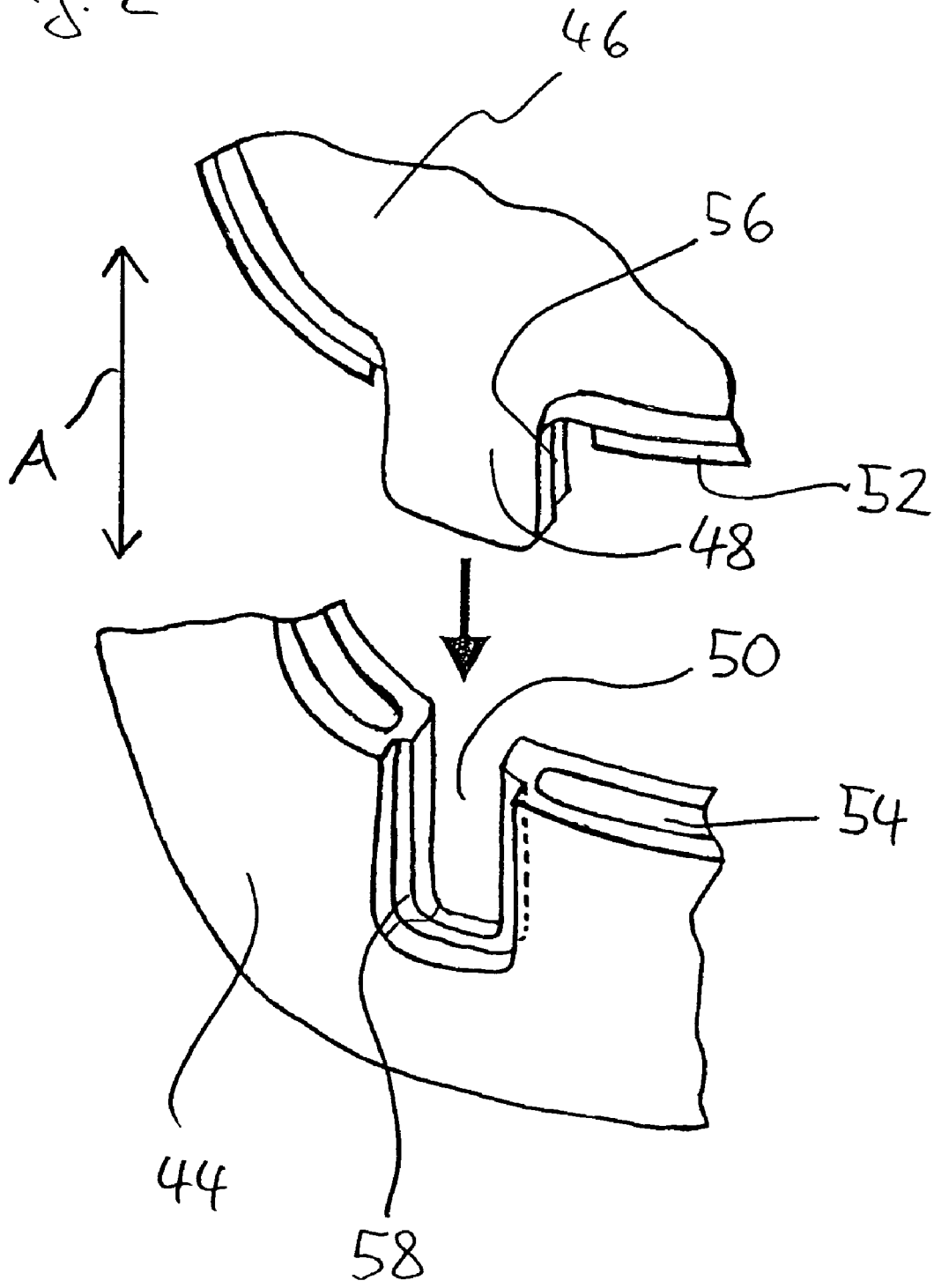
FIG. 2 is a perspective view of the detail of an outer casing of the injector housing arrangement during mounting.

Therefore, FIG. 2 shows the embodiment of the gas exchange opening 42 when mounting the casing cover 46 onto the molding 44. In this way, the cover 46 has on its circumference a locating lug 48 protruding in an axial direction A that on mounting (arrow in FIG. 2) interlocks with a recess 50 provided in the molding 44, in which case a small gap remains between the locating lug 48 and the edge of the recess 50 that in the mounted state forms the labyrinth-type gas exchange opening 42 (FIG. 1). The ultrasonic welding of the cover 46 on the molding 44 in this case follows in the area of the penetration of a welding profile (spring), also protruding in an axial direction, of the cover 46 in a corresponding welding profile 54 (groove) of the molding 44. The advantageous "labyrinth design" of the gap 42 remaining between these two casing components is in this case created by corresponding steps 56, 58 that are provided in the radial course of the locating lug 48 or the edge of the recess 50.

As a result, this development with a welded on plastic cover 46 can also advantageously reduce the material plurality because, for example, a sealing material such as epoxy resin need not be used. This in particular simplifies the recycling if no duroplastic materials at all are used. The production process of the fuel injector also does not need an intermediate storage procedure on the basis of a hardening process which would slow down the cycle length.

In principle, deviating from the shown embodiment it is feasible to provide a customary plastic molding consisting of one part in the same way as for the customary fuel injectors, but which is subsequently perforated for creating at least one gas exchange opening (e.g. bored). However, for a labyrinth-type design of the gas exchange opening, an embodiment consisting of several parts is more suitable in the same way as for example described with reference to FIG. 2.

Therefore, coming back to FIG. 1 once more, it is possible to identify a separating web 31 protruding downward in the axial direction from the cover 46 that engages in a corresponding groove on the top of the support element of the contact module 30 (or alternatively presses from the top on the support element). As a result, a "labyrinth seal" (with a limited remaining gap) is created in this area which separates the area above the contact module 30 into two individual chambers. This for example has the advantage that an electrical short-circuit can be avoided between the terminal pins 10 on the basis of a possible electrical conductivity of an agent that has penetrated this area.

In the following description of additional embodiments, the same reference numbers are used for similar components, but in each case supplemented by a small letter in order to distinguish the embodiment. As a result, only the differences between the already described embodiments are discussed in essence and with this reference is made further on explicitly to the description of the preceding embodiments.

Figure 3:
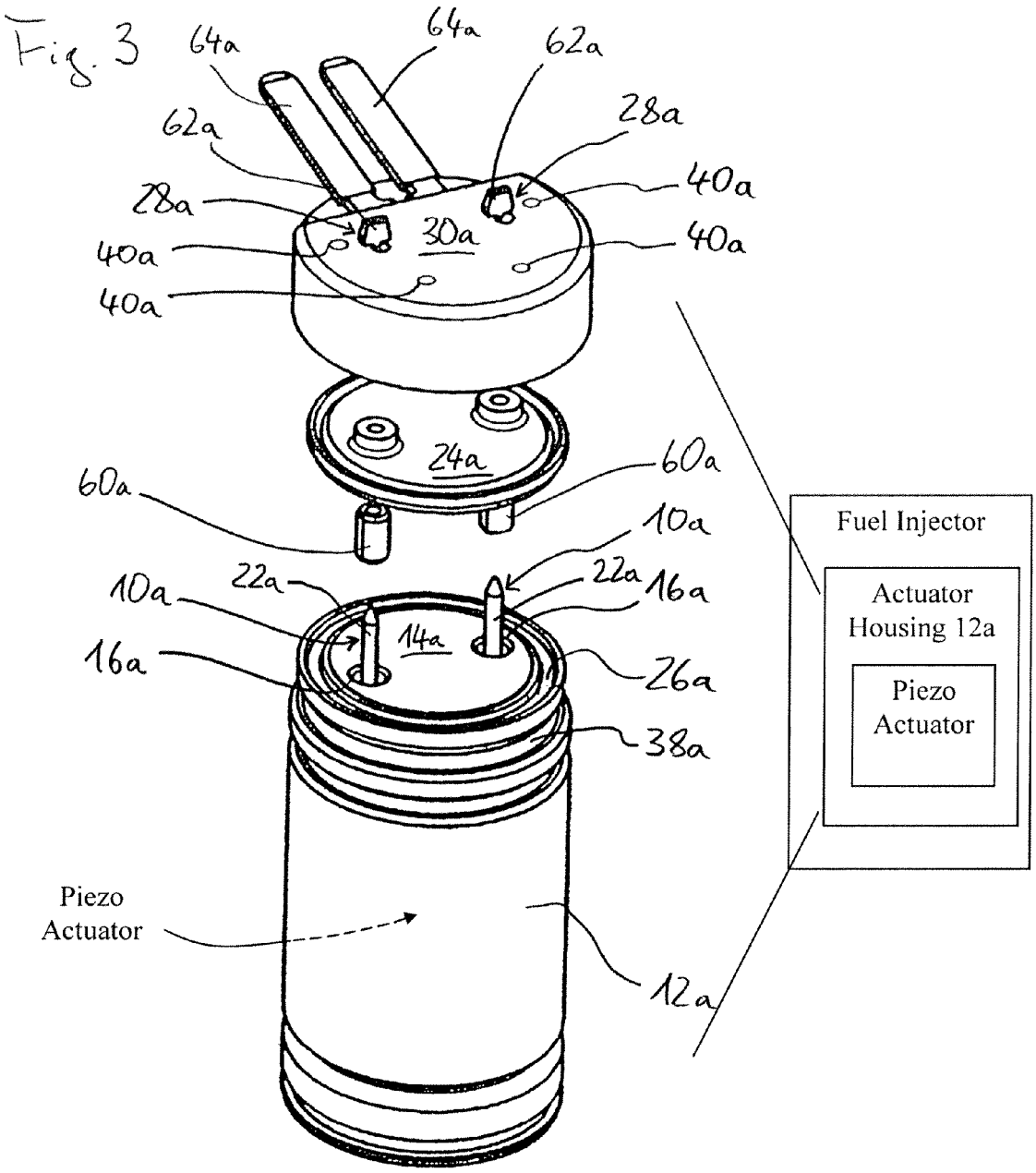
FIG. 3 is an exploded view of the main components of a piezo-drive with a mounted contact module for a fuel injector according to an additional embodiment.

FIG. 3 shows a modification of the fuel injector described with reference to FIGS. 1 and 2. The modification consists of the fact that conventional insulating sleeves 60*a* are used in the bores 16*a* of a cover plate 14*a* instead of a perforated insulating sleeve with sleeve extensions to center and electrically insulate the terminal pins. Otherwise, the embodiment shown in FIG. 3 conforms to the embodiment that has already been described above. Likewise, a disk-shaped sealing element 24*a* consisting of one part is, in essence, mounted onto the protruding terminal pin sections 22*a* and is pressed by an annular circumferential molding into an annular groove 26*a* at the front of an actuator housing 12*a*.

As a result, in FIG. 3 four gas exchange openings 40*a* can also be seen in a support element of a contact module 30*a* which promote an exchange of gas between the bottom and the top of the contact module 30*a*. Finally, metallic weld-on clips 62*a* can also be identified in FIG. 3 which are welded to the upper ends of the terminal pins 10*a* after the shown components have been mounted and are led sideways out of the support element of the contact module 30*a* and there form the contact tongues 64*a* of an external connector. The remaining components of the connector are made by a final plastic molding (of polyamide) not shown in FIG. 3.

In this way, with the described embodiments, a high permeation rate of "volatile materials" from the actuator chamber and of oxygen into the actuator chamber and oxygen can be achieved or promoted. The higher or lower gas permeability of the sealing material used can specifically be selected to further increase this permeation rate.

On the basis of the provision of gas exchange openings in the area of the injector housing arrangement, an injector housing can advantageously be used further by the already well-established methods of plastic molding and/or a sealing compound made of epoxy resin. As a result, the gas exchange capability of this outer casing is independent of its material and has already been ensured by the gas exchange openings. The number and arrangement of such gas exchange openings of the injector housing arrangement as well as of any gas exchange openings of a separate contact module accommodated in the inside of the injector housing arrangement, if required, can be varied according to the design requirements.

As a result, the materials can be selected very freely both for the outer casing and for a contact module because the exchange of gas is provided or promoted by the gas exchange openings in an advantageous way. This results in a good ventilation of the piezo-actuator and hence increases the service life.

I claim:

1. A fuel injector comprising:

a piezo-actuator in electrical communication with one or more piezo-actuator terminal pin, an injector housing arrangement comprising a piezo-housing; a contact module, and a cover, wherein the piezo-housing houses the piezo actuator, and wherein the cover defines one or more cover openings, wherein each cover opening is configured to receive one of the piezo-actuator terminal pins such that a section of each terminal pin protrudes through a respective cover opening, a sealing element formed from a liquid-tight material, wherein the sealing element forms a seal with a circumferential area around each terminal pin and forms a seal between the piezo-housing and the contact module, and a ventilation system that promotes an exchange of gas between an area outside of the injector housing arrangement and an area outside of the sealing element, the ventilation system comprising one or more gas exchange openings formed in the injector housing arrangement.

2. The fuel injector according to claim 1, wherein at least one of the gas exchange openings is formed in the contact module.

3. The fuel injector according to claim 2, wherein the contact module presses at least a section of the sealing element against the piezo-housing.

4. The fuel injector according to claim 1, wherein the contact module presses at least a section of the sealing element against the piezo-housing.

5. The fuel injector according to claim 1, wherein the contact module embraces a circumferential area of the piezo-housing and is held in this circumferential area by a snap-in connection.

6. The fuel injector according to claim 1, wherein the injector housing arrangement comprises an outer casing, wherein the outer casing comprises at least one labyrinth-type gas exchange opening.

7. The fuel injector according to claim 1, wherein the injector housing arrangement comprises a casing cover and a casing molding and a labyrinth-type gas exchange opening between the casing cover and the casing molding.

8. The fuel injector according to claim 1, wherein each gas exchange opening is designed in such a way that a liquid that has penetrated into the inside of the injector housing arrangement can again flow out.

9. The fuel injector according to claim 1, wherein the material of the sealing element comprises an elastomer.

10. The fuel injector according to claim 1, wherein the material of the sealing element is electrically insulating.

11. The fuel injector according to claim 1, wherein the sealing element comprises a gas permeable material.

12. The fuel injector according to claim 11, wherein the sealing element comprises a silicon material.

13. The fuel injector according to claim 11, wherein the sealing element comprises a fluoride silicon material.

14. A fuel injector comprising:

an injector housing arrangement comprising:

a piezo-housing, housing a piezo actuator having one or more piezo-actuator terminal pins, having one or more piezo-actuator terminal pins, a cover defining one or more cover openings, wherein each cover opening is configured to receive one of the piezo-actuator terminal pins such that a section of each terminal pin protrudes through a respective cover opening, a contact module mounted onto the piezo-housing for the subsequent electrical connection of the terminal pins to a connector, wherein the contact module comprises at least one gas exchange opening, a sealing element formed from a liquid-tight, gas-permeable material, wherein the sealing element forms a seal with a circumferential area around each terminal pin and forms a seal between the piezo-housing and the contact module, and a ventilation system that promotes an exchange of gas between an area outside of the injector housing arrangement and an area outside the sealing element, the ventilation system comprising the gas-permeable sealing element and the at least one gas exchange opening of the contact module.

15. The fuel injector according to claim 14, wherein the contact module presses at least a section of the sealing element against the piezo-housing.

16. The fuel injector according to claim 14, wherein the contact module embraces a circumferential area of the piezo-housing and is held in this circumferential area by a snap-in connection.

17. The fuel injector according to claim 14, wherein the injector housing arrangement comprises an outer casing, wherein the outer casing comprises at least one labyrinth-type gas exchange opening.

18. The fuel injector according to claim 17, wherein each labyrinth-type gas exchange opening is designed in such a way that a liquid that has penetrated into the inside of the injector housing arrangement can again flow out.

19. The fuel injector according to claim 14, wherein the injector housing arrangement comprises a casing cover and a casing molding and a labyrinth-type gas exchange opening between the casing cover and the casing molding.

* * * * *